US007806570B2

(12) United States Patent
Lanczy

(10) Patent No.: US 7,806,570 B2
(45) Date of Patent: Oct. 5, 2010

(54) REINFORCEMENT FOR LINEAR INDIRECT LIGHTING FIXTURES

(75) Inventor: Geza T. Lanczy, Auburn, IN (US)

(73) Assignee: Group Dekko, Inc., Kendallville, IN (US)

( * ) Notice: Subject to any disclaimer, the term of this patent is extended or adjusted under 35 U.S.C. 154(b) by 310 days.

(21) Appl. No.: 11/961,433

(22) Filed: Dec. 20, 2007

(65) Prior Publication Data

US 2009/0161353 A1 Jun. 25, 2009

(51) Int. Cl.
*F21S 8/06* (2006.01)

(52) U.S. Cl. ..... 362/404; 362/217.16; 362/457

(58) Field of Classification Search ..... 362/217.16, 362/404, 430, 457, 217.01, 225, 352
See application file for complete search history.

(56) References Cited

U.S. PATENT DOCUMENTS

| | | | | |
|---|---|---|---|---|
| 2,259,151 | A | 10/1941 | Claspy | 240/128 |
| 2,525,315 | A * | 10/1950 | Schepmoes | 362/223 |
| 2,643,328 | A | 6/1953 | Elmendorf | 240/51.11 |
| 2,831,962 | A | 4/1958 | Winkler | 240/9 |
| 3,263,071 | A | 7/1966 | Fabbri | 240/51.11 |
| 3,389,249 | A | 6/1968 | Rackley | 240/147 |
| 3,473,280 | A | 10/1969 | Stahlhut | 52/475 |
| 3,492,475 | A | 1/1970 | Reis | 240/128 |
| 4,933,821 | A * | 6/1990 | Anderson | 362/223 |
| 6,152,573 | A | 11/2000 | Mitchell | 362/217 |
| 6,964,502 | B1 * | 11/2005 | Verfuerth | 362/217.09 |
| 7,156,537 | B1 | 1/2007 | Cohrs | 362/147 |
| 7,204,603 | B1 * | 4/2007 | Lanczy et al. | 362/150 |

FOREIGN PATENT DOCUMENTS

| | | |
|---|---|---|
| JP | 2004342486 | 2/2004 |

* cited by examiner

*Primary Examiner*—Gunyoung T Lee
(74) *Attorney, Agent, or Firm*—Taylor IP, PC

(57) ABSTRACT

An elongated indirect lighting fixture having a upwardly directed shallow concave sheet element suspended at its ends with spars interconnected along the outer marginal edges of the reflector element. The spars are preformed in an upward and inward direction to resist sagging both in a downward direction and an outward direction so that the lighting fixture, as represented by the sheet element, is substantially linear.

20 Claims, 3 Drawing Sheets

REINFORCEMENT FOR LINEAR INDIRECT LIGHTING FIXTURES

BACKGROUND OF THE INVENTION

1. Field of the Invention

The present invention relates to lighting and more specifically to linear indirect lighting fixtures.

2. Description of the Related Art

Linear indirect lighting has been used for many years to illuminate industrial and commercial buildings by providing a light source adjacent the ceiling of a room and projecting rays onto the ceiling to provide a more uniform lighting for the interior space. Such linear indirect lighting assemblies generally are suspended or supported at the ends thereof. This is to minimize the number of shadows that are thrown onto the ceiling by the supports leading up to the ceiling. The basic aesthetic component (that is the observable portion of the fixture) of the indirect lighting fixture is an elongated sheet-like element, usually formed from metal. The sheet-like element is shaped in various cross-section configuration so that a concave side faces the ceiling, although it is possible under some circumstances to have it face downward. In typical commercial fixtures, the concavity of the sheet has to be relatively flat. In addition to the function of a reflector element, the sheet-like element may provide a support for a separate reflector, as well as a mounting and support for electrical wiring, ballast and other usual components of such a lighting fixture. This shallow concavity presents a problem when the indirect lighting fixtures are provided in substantial lengths, usually from eight to twelve feet. With a length of this type, there is a significant portion of the midsection not supported by any external structure. Consequently, the sheet metal may be subjected to bends and distortion from the stress generated by the weight of the sheet element itself. This becomes a particular problem because the sheet element, in addition to providing other functions for the fixture, also provides an aesthetic component since its exterior is the observable portion of the fixture. Visual observation by a person can detect distortions of as little as one thousands of an inch so it is imperative that the geometry of the semi-circular sheet-like element be maintained uniformly.

What is needed in the art is a reinforcement for light fixtures of this type that maintains a uniform geometry and is simple and effective.

SUMMARY OF THE INVENTION

In one form, the invention is a supporting structure for an elongated lighting fixture including an elongated sheet element of the fixture having a generally uniform cross-section with a shallow concave face and at least one elongated spar interconnected with the elongated sheet element at least at several locations along the length of the spar and sheet element. The spar is preformed into a curved form relative to its longitudinal axis prior to interconnection with the sheet element so that the supporting structure is substantially linear and resists sagging.

In another form, the invention is an elongated light fixture which includes at least a pair of electrical and structural mountings for an elongated lighting element. An elongated sheet element is connected to and extends between the mountings, the sheet element having a generally uniform cross-section with a shallow concave face. At least one elongated spar is interconnected with the elongated sheet element at least at several locations along the length of the spar and the sheet element. The spar is preformed into a curved form relative to the longitudinal axis thereof prior to interconnection with the sheet element so that the light fixture is substantially linear and resists sagging.

In yet another form, the invention is a method of reinforcing an elongated lighting fixture including the steps of forming an elongated sheet element of the fixture into a form having a generally uniform cross-section with a shallow concave face. An elongated spar is formed into a curved form relative to its longitudinal axis. The elongated spar and the sheet element are interconnected at least at several locations along the length of the spar and the sheet element so that the resultant fixture is substantially linear and resists sagging.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrates one embodiments of the invention and such exemplification is not to be construed as limiting the scope of the invention in any manner.

DETAILED DESCRIPTION OF THE INVENTION

Figure 1:
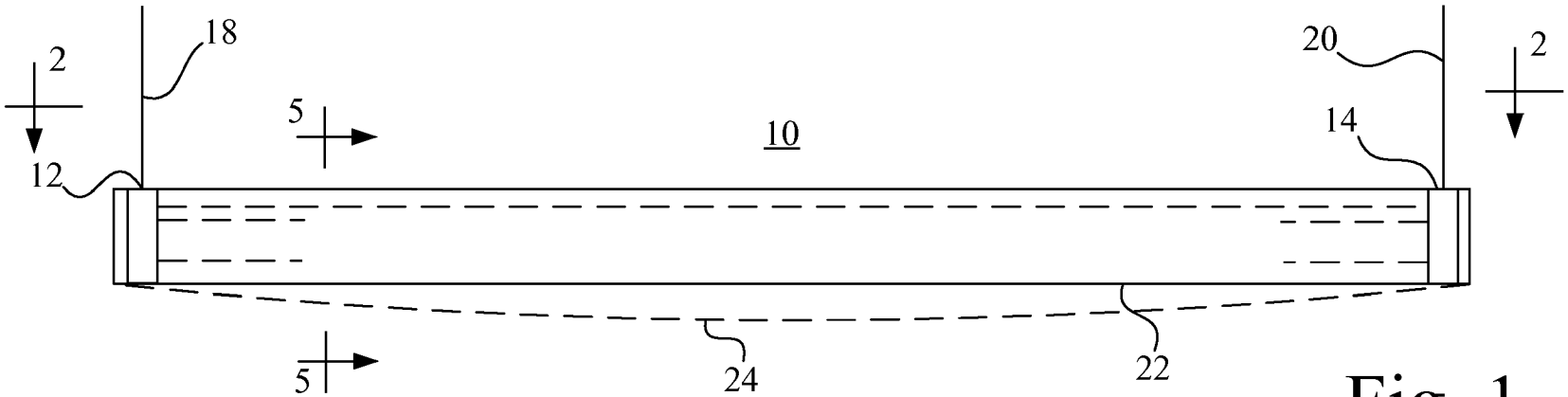
FIG. 1 is a side view of a linear indirect lighting fixture embodying the present invention.
Figure 2:
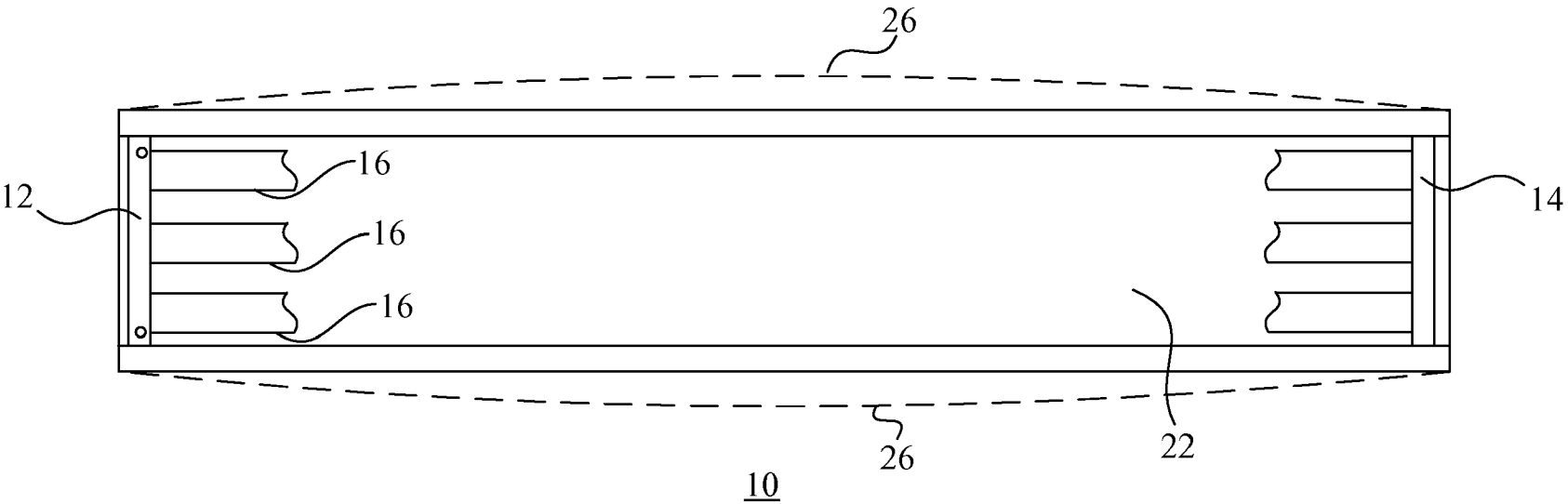
FIG. 2 is a plan view of FIG. 1 taken on lines 2-2 of FIG. 1.
Figure 5:
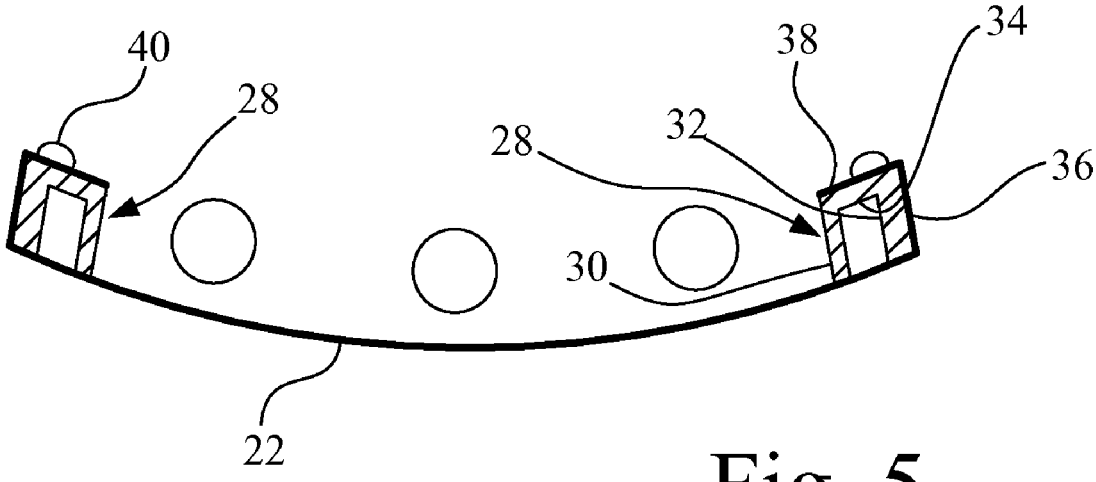
FIG. 5 is an enlarged cross-section view of the lighting fixture of FIG. 1 taken on lines 5-5 of FIG. 1.

Referring now to the drawings and more particularly to FIGS. 1, 2 and 5, there is shown a linear indirect lighting fixture 10 having supports 12 and 14 for a plurality of elongated lighting elements 16, herein illustrated as fluorescent tubes. The tubes 16 come in standard lengths up to twelve feet long, with the usual length for commercial and industrial fixtures being 8 to 12 feet. The support elements 12 and 14 are typically suspended from a ceiling by cables 18 and 20, or other appropriate means of suspension. An element 22 is employed that extends between structural elements 12 and 14. Element 22 is in sheet form, usually from steel and has a thickness from 20 to 22 gauge. Sheet element has a generally uniform cross section with a shallow concave face facing upward as shown in FIG. 1. As shown particularly in FIG. 5, the element 22 has a semi-circular cross section with a shallow concavity. It should be apparent, however that other cross-sectional shapes may be employed to span the distance between the supports 12 and 14. Sheet element 22 may function as shown to be a reflector curved to disperse the light over a greater portion of a ceiling for indirect lighting. Some reflectors 22 are provided with no direct down light so that they are essentially opaque. Other elements may have one or more openings to direct a portion of the light from the fluorescent tube 16 directly downward, as well as upward. In still other instances, a separate reflector may be carried by sheet element 22, as well as various electrical components.

In either case, the requirement that the lighting fixture 10 be suspended from its ends, for example by cables 18 and 20, means that all the inherent weight of the sheet element 22 is only supported by its end portions. As a result, the element 22 has a tendency to sag downward to a dashed line indicated at 24 in FIG. 1. This line is exaggerated for purposes of illustration but in practice the sagging is enough so that it can be observed as an irregular structure. In addition to the downward sagging illustrated by dash line 24 in FIG. 1, the element 22 exhibits a characteristic referred to as canoeing where the sides additionally expand to dash lines 26 shown in FIG. 2., further exaggerating the deviation from a uniform, linear structure.

Figure 3:
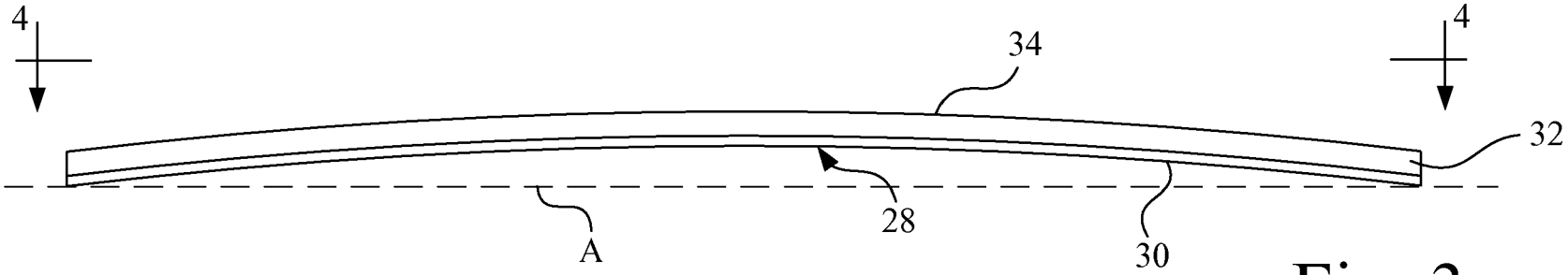
FIG. 3 is a side view of a spar used in the lighting fixture of FIG. 1.
Figure 4:
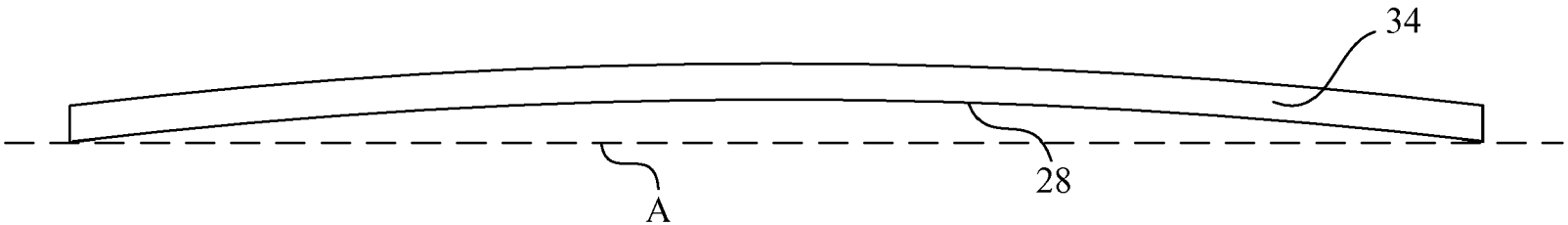
FIG. 4 is a top view of a spar used with the wetting fixture of FIG. 1.

In accordance with the present invention, a spar 28, shown in FIGS. 3 and 4 is employed to minimize, if not eliminate the deficiencies described above. Spar 28, as particularly shown in FIG. 5, has a generally U-shaped cross-section with a first longer leg 30 and a second shorter leg 32 positioned outboard of the longer leg 30. Legs 30 and 32 are inter-connected by an integral section 34. As shown in FIG. 3, spar 28 is formed to a curved form that deviates from a linear longitudinal axis A in a direction, when installed that is towards the ceiling to which the lighting fixture 10 is attached. As shown in FIG. 4, the spar 28 is also formed to a curve that departs from a linear axis A for the spar inward towards the center of the lighting fixture 10. This multidimensional curve is a result of the different lengths of the legs 30 and 32 forming the generally U-shaped cross-section. The spar 28 is sized so that it fits under bent over marginal edges 36 and 38, integral with element 22. As shown in FIG. 5, the spar 28 is affixed to the element 22 by rivets 40 extending through element 38 at a plurality of locations along the length of the element 22 and the spars 28. It should be apparent, however, that means other than rivets may be employed to affix the portions together, including spot welding, adhesives and even forming an additional marginal edge of element 22 to capture spars 28.

The curvature of each spar 28 is selected so that when it is inserted in-between the elements 36 and 38, it exhibits a force opposite to the gravity forces that cause the sagging exhibited by dashed lines 24 and 26 in FIGS. 1 and 2. The resulting structure exhibits substantially a linear shape when installed and suspended by its ends, for example through cables 18 and 20. This ensures that the aesthetic portion contributed by the element 22 is maximized by having a form that is substantially linear to the observer.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A supporting structure for an elongated lighting fixture, said supporting structure comprising:

an elongated sheet element of said fixture having a generally uniform cross section with a generally shallow concave face; and at least one elongated spar interconnected with said elongated sheet element at least at several locations along the length of said spar and said sheet element, said spar being preformed into a curved form relative to the longitudinal axis thereof prior to interconnection with said sheet element so that the supporting structure is substantially linear and resists sagging.

2. A supporting structure as claimed in claim 1, having a pair of elongated spars.

3. A supporting structure as claimed in claim 2, wherein said elongated sheet element has outer marginal edges and said spars are positioned along the outer marginal edges of said sheet element.

4. A supporting structure as claimed in claim 3, wherein said elongated sheet element has a flange on the outer marginal edges thereof at least partially embracing said spars.

5. A supporting structure as claimed in claim 4, wherein said sheet element and said spars are secured to one another by riveting.

6. A supporting structure as claimed in claim 1, wherein said elongated sheet is positioned with the concave portion of the sheet element in a given orientation relative to gravity and said spar is pre-formed in a bend in a direction away from gravity.

7. A supporting structure as claimed in claim 3, wherein said spars are preformed into a curve in a direction generally inward between said marginal edges.

8. A supporting structure as claimed in claim 7, wherein said elongated sheet element has the concave portion thereof facing in an upper direction relative to gravity.

9. A supporting structure as claimed in claim 8, wherein said sheet element has a flange structure at least partially embracing said spars.

10. A supporting structure as claimed in claim 9, wherein said spars have a generally U-shaped cross-section.

11. A supporting structure as claimed in claim 10, wherein said U-shaped section has one leg of the section longer than the other, thereby causing the spar to be preformed in two dimensions relative to the longitudinal axis thereof.

12. An elongated light fixture comprising:

at least a pair of electrical and structural mountings for an elongated lighting element;

an elongated sheet element connected to and extending between said mountings, said sheet element having a generally uniform cross section with a shallow concave face;

at least one elongated spar interconnected with said elongated sheet element, at least at several locations along the length of said spar and said sheet element, said spar being preformed into a curved form relative to the longitudinal axis thereof prior to interconnection with said sheet element so that the light fixture is substantially linear and resists sagging.

13. An elongated light fixture as claimed in claim 12, having a pair of elongated spars.

14. An elongated light fixture as claimed in claim 13, wherein said elongated sheet has outer marginal edges and said spars are positioned along the outer marginal edges thereof.

15. An elongated light fixture as claimed in claim 14, wherein said elongated sheet element has a flange on the marginal edges thereof at least partially embracing said spar.

16. An elongated light fixture as claimed in claim 15, wherein said spar has a U-shaped cross section.

17. An elongated light fixture as claimed in claim 16, wherein said sheet element is oriented so that the concave portion thereof faces upward and said U-shaped spars have the open end thereof facing in a downward direction.

18. An elongated light fixture as claimed in claim 17, wherein said U-shaped spars have one leg of the section longer than the other, thereby causing the spar to be preformed in two dimensions relative to the longitudinal axis thereof.

19. A method of re-enforcing an elongated lighting fixture comprising the steps of:

forming an elongated sheet element of said fixture into a form having a generally uniform cross section with a shallow concave face;

forming an elongated spar into a curved form relative to the longitudinal axis thereof; and subsequently interconnecting said sheet element and said spar at least at several locations along the length of said spar and sheet element so that the resultant fixture is substantially linear and resists sagging.

20. A method as claimed in claim 19, wherein said spar has a U-shaped cross section with one leg of the section longer than the other, thereby causing the spar to be preformed in two dimensions relative to the longitudinal axis thereof.

* * * * *